United States Patent [19]

deVulpillieres

[11] 4,245,312

[45] Jan. 13, 1981

[54] ELECTRONIC FUEL INJECTION COMPENSATION

[75] Inventor: Didier J. deVulpillieres, Southfield, Mich.

[73] Assignee: The Bendix Corporation, Southfield, Mich.

[21] Appl. No.: 881,983

[22] Filed: Feb. 27, 1978

[51] Int. Cl.[3] ..... F02B 3/10; F02D 5/00; F02M 7/06

[52] U.S. Cl. ..... 364/431; 123/486

[58] Field of Search ..... 364/424, 435, 431; 123/32 EA, 32 EH, 32 EB, 32 EC, 117 D, 119 EC, 119 R

[56] References Cited

U.S. PATENT DOCUMENTS

| | | | |
|---|---|---|---|
| 3,661,126 | 5/1972 | Baxendale | 123/32 EH |
| 3,749,065 | 7/1973 | Rothfusz et al. | 123/32 EH |
| 3,858,561 | 1/1975 | Aono | 123/119 R |
| 3,893,432 | 7/1975 | Krupp et al. | 123/32 EA |
| 3,969,614 | 7/1976 | Moyer et al. | 123/32 EA |
| 3,983,851 | 10/1976 | Hoshi | 364/431 |
| 4,020,802 | 5/1977 | Hattori et al. | 123/32 EH |
| 4,126,107 | 11/1978 | Harada et al. | 123/32 EH |
| 4,159,697 | 7/1979 | Sweet | 123/32 EH |
| 4,176,625 | 12/1979 | Stauffer | 123/32 EH |
| 4,184,461 | 1/1980 | Leung | 123/32 EH |

*Primary Examiner*—Felix D. Gruber

*Attorney, Agent, or Firm*—Gaylord P. Haas, Jr.; Russel C. Wells

[57] ABSTRACT

A method and apparatus for controlling the various functions of an internal combustion engine using a program-controlled microprocessor having a memory preprogrammed with various control laws and associated control schedules receives information concerning one or more engine-operating parameters such as manifold pressure, throttle position, engine coolant temperature, air temperature, engine speed or period and the like. These parameters are measured and their values are supplied to input circuits for signal conditioning and conversion into digital words usable by the microprocessor. The microprocessor system computes a digital word indicative of a computer-commanded engine control operation and output circuitry responds to predetermined computer-generated commands and to the computed digital command words for converting them to corresponding pulse-width control signals for controlling such engine operations as fuel-injection, ignition timing, proportional and/or on-off EGR control, and the like. Various techniques for modifying the basic fuel control laws stored in the memory are provided for acceleration enrichment purposes and look-up tables of such values stored in the memory may include any number of break points or thresholds since a unity intercept concept is used in the interpolation process to compute the appropriate modifier value.

11 Claims, 1 Drawing Figure

*Microprocessor-Based Electronic Engine Control System*

Microprocessor-Based Electronic Engine Control System

ELECTRONIC FUEL INJECTION COMPENSATION

BACKGROUND OF THE INVENTION

1. Field Of The Invention

This invention relates generally to a method and apparatus for controlling an internal combustion engine, and more particularly to a microprocessor-based electronic engine control system having a memory preprogrammed with various control laws and control schedules responsive to one or more sensed engine-operating parameters and generating signals for controlling fuel injection, ignition timing, EGR control, and the like.

2. Statement Of The Prior Art

Many of the patents of the prior art recognize the need for employing the enhanced accuracy of digital control systems for more accurately controlling one or more functions of an internal combustion engine.

U.S. Pat. No. 3,969,614 which issued to David F. Moyer, et al on July 13, 1976 is typical of such systems as are U.S. Pat. No. 3,835,819 which issued to Robert L. Anderson, Jr. on Sept. 17, 1974; U.S. Pat. No. 3,904,856 which issued to Louis Monptit on Sept. 9, 1975; and U.S. Pat. No. 3,906,207 which issued to Jean-Pierre Rivere, et al on Sept. 16, 1975. All of these Patents represent a break-away from the purely analog control systems of the past, but neither the accuracy, reliability, or number of functions controlled is sufficient to meet present day requirements.

Future internal combustion engines will require that emissions be tightly controlled due to ever-increasing governmental regulations, while fuel consumption is minimized and drivability improved over the entire operating range of the engine. None of the systems of the prior art provide a method and apparatus for controlling the operation of an internal combustion engine over even a portion of its operating range with sufficient accuracy to attain minimal emissions and minimal fuel consumption while simultaneously obtaining improved drivability.

The systems of the prior art attempt to control one or more of the engine-operating functions but none attempts to control the operation of the fuel pump, fuel injection, engine ignition timing, on-off and/or proportional EGR control, and the like while using feedback from such devices as oxygen sensors for emission control purposes or for effecting a closed loop fuel control mode of operations, yet including provisions for optimizing acceleration enrichment handling, and the like. Moreover, the systems of the prior art are extremely expensive, difficult to repair and maintain and are not commercially feasible at the present time.

These and other problems of the prior art are solved by the microprocessor-based electronic engine control system of the present invention which eliminates most or all of the problems of the prior arts and enables a commercially feasible implementation of a digital control system having a relatively low cost, and which is easy to repair and maintain. The system of the present invention is able to implement much more advanced and complex fuel control laws and expand on the number of control functions performed thereby to include the timing and duration of ignition, on-off and/or proportional EGR control and the like while at the same time reducing the cost and size of the unit and increasing reliability so as to render the system commercially feasible.

These and other objects and advantages of the present invention will be accomplished by the present method and apparatus for the microprocessor-based electronic engine control of nearly all engine functions over the entire operating range of the engine to minimize engine emissions and fuel consumption while simultaneously maintaining, if not improving, drivability and the like.

SUMMARY OF THE INVENTION

The method and apparatus of the present invention includes means for detecting a need for acceleration enrichment and generating a reliable initial acceleration enrichment pulse, commonly called a Tip-In pulse, followed by an additional acceleration enrichment amount determined at least partially as a function of engine speed and the like to augment the main fuel pulse.

The additional acceleration enrichment amount is determined as a One Factoral enrichment of the primary main fuel pulse $T_p(N)$ computed for normal fuel injection purposes.

If $T_p(N)$ is the duration of the normal main or primary fuel pulse, $T_p(AE)$ is the duration of the total fuel pulse after an acceleration enrichment correction is factored in and "K" is the factoral enrichment factor, then $T_p(AE)=T_p(N)\times(1+K)$.

The factoral enrichment factor "K" is a function of engine speed (RPM), air temperature and a decay factor where the decay factor is a modifier value addressed by the number of engine revolutions which have elapsed since the initiation of the acceleration enrichment enable sequence began. Therefore, $K=K_{RPM}+K_{AIR\ TEMP}+K_{DECAY}$.

The present system ensures that if the acceleration enrichment Tip-In pulse is generated during the period of a previously-computed mean or primary fuel pulse, then the Tip-In pulse is delayed until the termination of the main fuel pulse and then immediately added to prolong the period of the fuel pulse to ensure that the one-time extra acceleration enrichment boost of fuel is not masked or lost during the main fuel pulse. Otherwise, the Tip-In pulse is immediately generated to provide an immediate one-time additional boost of fuel to compensate for acceleration enrichment.

A unity intercept concept is used for defining various breakpoints in the required look-up table of values stored in the memory so as to permit the use of a process for interpolating between two address values X1 and X2 to compute an overall modifier value or correction factor to be applied during fuel pulse calculation which corresponds to the actual input variable X, and at the end of the computed interpolation, the overall correction factor is compared with a level of "one" and the highest of the two, i.e., the computed correction factor or the value "1" is the only number used as the table output correction factor or value for computation purposes. With this approach, any threshhold level and any number of breakpoints between successive addressable values X1, X2 may be used regardless of limitations on the number of memory addresses available.

INCORPORATION BY REFERENCE

Figure 2:
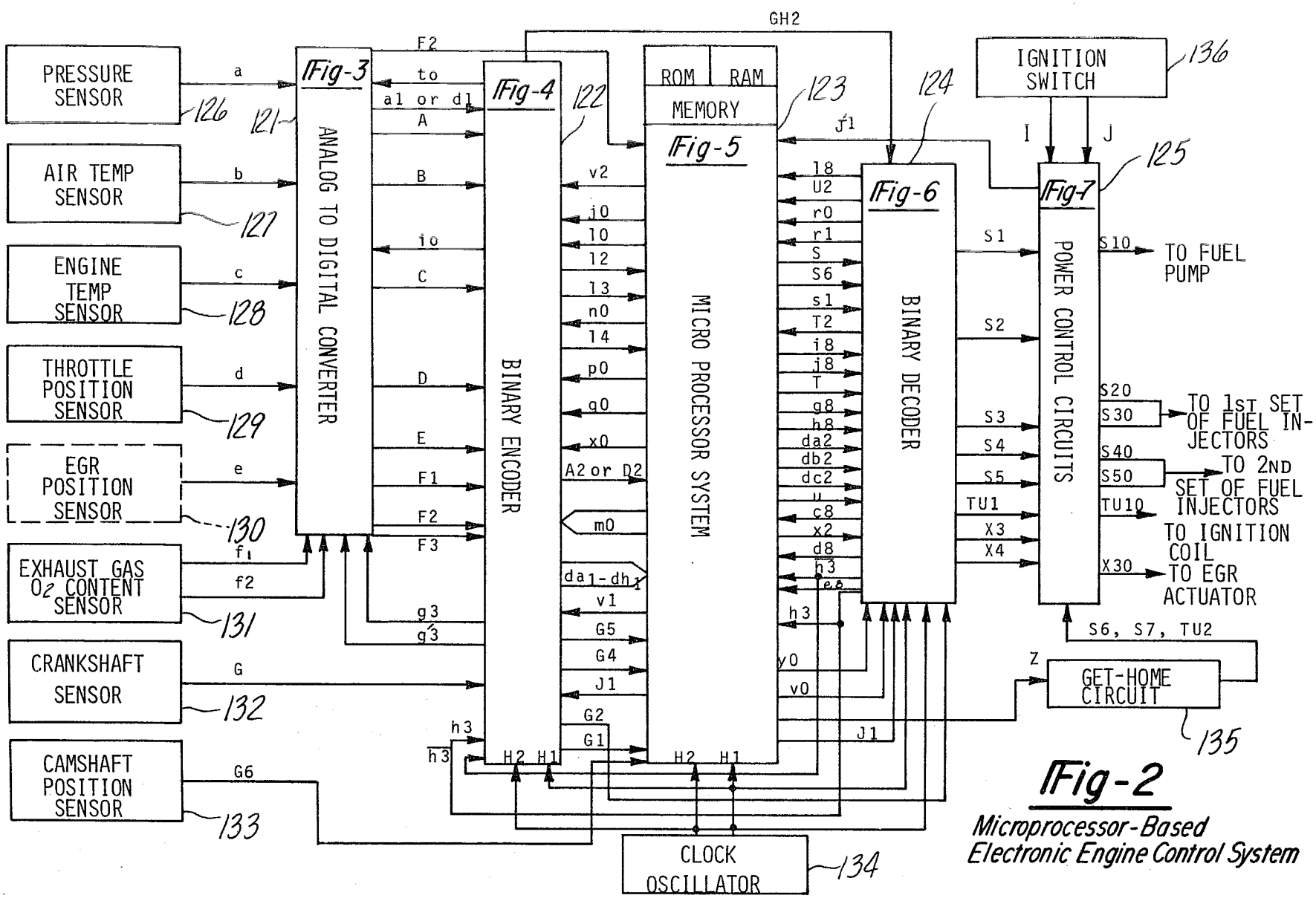
FIG. 2 is a block diagram of the microprocessor-based electronic engine control system.

This application is one of fourteen applications filed on Feb. 27, 1978, all commonly assigned and having substantially the same specification and drawings, the fourteen applications being identified below:

| Serial Number | Title |
|---|---|
| 881,321 | Microprocessor-Based Electronic Engine Control System |
| 881,322 | Feedback-Compensated Ramp-Type Analog to Digital Converter |
| 881,323 | Input/Output Electronic For Microprocessor-Based Engine Control System |
| 881,324 | Switching Control of Solenoid Current in Fuel Injection Systems |
| 881,921 | Dual Voltage Regulator With Low Voltage Shutdown |
| 881,922 | Oxygen Sensor Qualifier |
| 881,923 | Ratiometric Self-Correcting Single Ramp Analog To Pulse Width Modulator |
| 881,924 | Microprocessor-Based Engine Control System Acceleration Enrichment Control |
| 881,925 | Improvements in Microprocessor-Based Engine Control Systems |
| 881,981 | Oxygen Sensor Feedback Loop Digital Electronic Signal Integrator for Internal Combustion Engine Control |
| 881,982 | Improvements in Electronic Engine Controls System |
| 881,983 | Electronic Fuel Injection Compensation |
| 881,984 | Ignition Limp Home Circuit For Electronic Engine Control Systems |
| 881,985 | Oxygen Sensor Signal Conditioner |

Application Ser. No. 881,321, has been printed in its entirety, including FIGS. 1 to 10.34 and the specification of that application is specifically incorporated by reference.

I claim:

1. An electronic engine control system for controlling the supply of fuel to an engine comprising means for measuring the time interval between engine position pulses and computing a digital number indicative of engine speed, computation means, memory means for storing a program for implementing at least one fuel control law, said program being executed by said computation means for implementing said at least one fuel control law to normally compute a primary fuel control pulse for controlling the supply of fuel to said engine, means for detecting engine operating conditions indicative of a need for acceleration enrichment and generating an acceleration enrichment request signal, means responsive to said acceleration enrichment request signal for addressing said memory means with said stored digital number indicative of engine speed for generating an acceleration enrichment modifier value signal which is a function of engine speed, said computational means executing said stored program for implementing said at least one fuel control law and programmably modifying the normally-computed primary fuel control pulse with said calculated acceleration enrichment modifier value signal for generating an elongated, acceleration enrichment-compensated primary fuel control pulse for controlling the supply of fuel to said engine to maintain smooth engine performance while avoiding "stumbling" and the like.

2. An electronic engine control system for normally generating a primary fuel injection pulse for controlling the quantity of fuel supplied to an engine including means for engine operating conditions indicative of a need for acceleration enrichment and generating an acceleration enrichment request signal in response thereto, and means responsive to said acceleration enrichment request signal for immediately generating an initial acceleration enrichment fuel injection pulse if no normally-generated primary fuel injection pulse is currently being outputted and delaying the generation of said initial acceleration enrichment fuel injection pulse whenever a normally-generated primary fuel injection pulse is being generated until immediately after the normal termination of said primary fuel injection pulse so that no portion of either said normally-generated primary fuel injection pulse or said initial acceleration enrichment fuel injection pulse is masked or lost during the outputting of the other and the total quantity of fuel supplied to said engine is sufficient to maintain smooth engine operation even during conditions of acceleration.

3. A method of operating a microprocessor-based electronic engine control system including a microprocessor means, memory means for storing at least one look-up table of modifier values computed as a function of at least one engine-operating parameter and program means for implementing at least one control law, means for measuring said at least one engine-operating parameter, said microprocessor means being responsive to said at least one measured engine-operating parameter for executing said program means for implementing said at least one control law to compute a particular engine control command, the method for addressing said look-up table and computing an exact modifier value corresponding to the actual measured value of said at least one engine-operating parameter for use in implementing said at least one control law by extending a straight line between pairs of addressed values below the correction factor of one utilizing a "unity intercept" technique to compute an overall correction factor compared to the level of "one" law to compute said program-implemented engine control command comprising the steps of:

(1) assigning a desired modifier value weight at a modifier value $Y_1$ for input address value $X_1$ and a value of "ONE" for the modifier value at a predetermined threshhold address level $X_t$;

(2) extending a straight line from $Y_1$, $X_1$ to "ONE", $X_t$ below the modifier value of "ONE";

(3) reading a $Y_2$ modifier value (lower than ONE) at the address value $X_2$;

(4) interpolating between the modifier values $Y_1$ and $Y_2$ by linear interpolation techniques to compute an overall modifier value corresponding to the actual measured value of engine-operating parameter represented by the input address variable X;

(5) comparing the computed overall modifier value Y to the value ONE; and (6) utilizing the greater of the computed modifier value Y and the value ONE to modify said programmably-computed engine control command thereby allowing any threshhold input value between the addressed values $X_1$ and $X_2$ to be selected regardless of the limited number of addressable locations for the variable input values corresponding to measured values of engine-operating parameters in the look-up table of modifier values stored in said memory means.

4. An electronic engine control system for use with an internal combustion engine system having an intake system, an exhaust system, an engine block, a plurality of cylinders disposed in said engine block, a piston operatively disposed within each of said plurality of cylinders for reciprocal movement therein, means responsive to fuel control signals for selectively supplying a controlled quantity of fuel to a selected one or more of said plurality of cylinders, the electronic engine control system comprising computer means, memory means operatively coupled to said computer means for storing data representative of at least one look-up table containing a control surface of modifier values computed as a function of engine speed, and program means for implementing at least one fuel control law, means for measuring engine speed and generating a signal indicative thereof, means for temporarily storing said signal indicative of engine speed, said computer means being responsive to said temporarily stored signal indicative of engine speed for addressing said at least one look-up table data of modifier values stored in said memory means and generating a signal representative of a particular modifier value corresponding to the actual measured value of engine speed represented by said temporarily stored signal, said program means utilizing said at least one fuel control law in response to said computed particular modifier value for generating a modified fuel control signal so that the controlled quantity of fuel supplied to a selected one or more of said plurality of cylinders for ignition purposes is a function of actual engine speed thereby maintaining smooth engine performance and good drivability while avoiding "stumble", "hesitation" and the like.

5. In an internal combustion engine system having computer means, memory means associated with said computer means, program means stored in said memory means for implementing at least one fuel control law to compute a fuel control signal, preparing a look-up table of modifier values which are a function of engine speed; storing said look-up table of modifier values which are a function of engine speed; storing said look-up table of modifier values in said memory means; and means responsive to said fuel control signal for controlling the quantity of fuel supplied to said engine, an improved method of acceleration enrichment compensation comprising the steps of:

measuring the speed of said engine to obtain a vaue indicative thereof and generating a measured engine speed signal;

addressing the stored look-up table of modifier values with said measured engine speed signal;

generating modifier value signals by interpolating between stored modifier values to compute the particular modifier value corresponding to said measured engine speed signal;

utilizing said program means including at least one fuel control law to generate said fuel control signal; and altering said at least one fuel control law by modifiying the fuel control signal with said predetermined computed modifier value signal corresponding to said measured engine speed signal to generate a compensated fuel control signal corrected for acceleration so as to maintain smooth engine performance and the like.

6. In an internal combustion engine system including means responsive to fuel control pulses for selectively controlling the quantity of fuel supplied to said engine and engine control means for normally computing primary fuel control pulses for operating said fuel supply means, an improved method of acceleration enrichment compensation comprising the steps of monitoring at least one of throttle angle and manifold absolute pressure, detecting a rapid change in said monitored one of said throttle angle and manifold absolute pressure as an indication of a need for acceleration enrichment, generating an extra additional one-time acceleration enrichment fuel control pulse in response to said detected need for acceleration enrichment, determining if the generation of said extra additional one-time acceleration enrichment fuel control pulse will occur during the normal generation of said primary fuel control pulse and generating a signal indicative thereof, immediately generating said extra additional one-time acceleration enrichment fuel control pulse in response to a signal indicating that said normally generated primary fuel control pulse is not currently being generated, and delaying the generation of said extra additional one-time acceleration enrichment fuel control pulse until immediately after the termination of said normally-generated primary fuel control pulse in response to a determination that said primary fuel control pulse is currently being generated for extending same to insure that no portion of either of said fuel control pulses is masked or lost and that said internal combustion engine receives sufficient fuel even during acceleration periods to maintain smooth engine performance and "drivability".

7. In an internal combustion engine having a control system for normally generating main fuel control pulses and means responsive to the duration of said fuel control pulses for selectively controlling the quantity of fuel supplied to said engine for combustion purposes, the improvement comprising acceleration enrichment compensation means including:

means for monitoring at least one engine manifold absolute pressure and throttle angle for detecting rapid changes therein;

means responsive to the detection of rapid changes in said monitored at least one of manifold absolute pressure and throttle angle for generating an acceleration enrichment enable signal indicative of a need for acceleration enrichment;

means responsive to said acceleration enrichment enable signal for normally generating a one-shot additional tip-in fuel control pulse upon the leading edge of said acceleration enrichment enable signal unless one of said normally-generated main fuel control pulses is currently being generated and for otherwise generating said one-shot additional Tip-In fuel control pulse immediately upon the termination of said normally-generated main fuel control pulse for effectively extending the pulse-width thereof; and means for modifying said normally-generated main fuel control pulse for longer term acceleration enrichment correction as a function of engine speed, air temperature and the number of engine revolutions elapsed since the generation of said acceleration enrichment enable signal.

8. The improved internal combustion engine system of claim 7 wherein said engine control system includes computer means, memory means operatively coupled to said computer means, program means stored in said memory means for execution by said computer means to implement at least one fuel control law, a first look-up table containing a control surface of first acceleration enrichment modifier values which are a function of engine speed, a second look-up table containing a control surface of second acceleration enrichment modifier values which are a function of air temperature, and a third look-up table containing a control surface of third acceleration enrichment modifier values which are a function of the number of engine revolutions which have elapsed since the generation of said acceleration enrichment enable signal, said internal combustion engine system further including means for measuring the actual speed of said engine and generating a RPM signal indicative thereof, means for measuring the actual air temperature and generating a TEMP signal indicative thereof, and means for counting the number of engine revolutions elapsed since the generation of said acceleration enrichment enable signal and generating a DECAY signal indicative thereof, said means for modifying said normally-generated fuel control pulses for longer term acceleration enrichment correction including means for performing a One Factoral Enrichment of said normally-computed main fuel control pulse such that if $T_P$ (N) represents the normally-computed main fuel pulse, $T_{P(AE)}$ represents the total acceleration enrichment-compensated main fuel control pulse needed to supply a sufficient quantity of fuel to said engine to maintain smooth engine performance and good "dirvability" and "K" represents the factoral enrichment factor, then $T_{P(AE)}=T_{P(N)}\times(1+K)$, where $K=K_{RPM}\times K_{AIR\ TEMP}\times K_{DECAY}$ where $K_{RPM}$ is said first acceleration enrichment modifier value which is a function of engine speed and which is determined by addressing said first look-up table with said RPM signal and interpolating to compute the particular first acceleration enrichment modifier value corresponding thereto, where $K_{AIR\ TEMP}$ represents said second acceleration enrichment modifier value which is a function of air temperature and which is determined by addressing said second look-up table of acceleration enrichment modifier values with said TEMP signal and interpolating to calculate the particular acceleration enrichment modifier value corresponding to the actual measured value thereof, and where $K_{DECAY}$ represents said third acceleration enrichment modiifier value which is determined from said third look-up table by addressing said table with said DECAY signal and interpolating on said control surface to calculate the particular third acceleration enrichment modifier value corresponding to the actual number of counts having elapsed since the generation of said acceleration enrichment signal.

9. An acceleration enrichment system for use with an internal combustion engine including means responsive to the measured values of one or more engine-operating parameters for normally generating primary fuel control signals and means responsive to the duration of said fuel control signals for selectively controlling the quantity of fuel supplied to said engine and therefore the operation thereof, said acceleration enrichment system including:

means for sensing engine-operating parameters and generating a signal indicative of a need for acceleration enrichment including generating an acceleration enrichment request signal in response thereto;

means responsive to said acceleration enrichment request signal for generating an immediate Tip-In acceleration enrichment fuel control pulse if no main fuel control pulse if currently being generated and for delaying the generation of said Tip-In acceleration enrichment fuel control pulse until immediately after the termination of said main fuel control pulse if said normally-generated main fuel control pulse is currently being generated; and means responsive to said acceleration enrichment request for additionally modifying said normally-generated main fuel control pulse to effect a longer term, more gradual acceleration enrichment correction so as to insure smooth engine performance and good drivability.

10. The acceleration enrichment system of claim 9 wherein said means for additionally modifying said normally-generated main fuel control pulse to effect said longer-term more gradual acceleration enrichment correction includes means for correcting said normally-generated main fuel control pulse by multiplying same by a One Factoral Factor (1+K) where "K" is a factor combining a first acceleration enrichment modifier value which is a function of engine speed, a second acceleration enrichment modifier value which is a function of air temperature, and a third acceleration enrichment modifier value which is a function of the number of engine revolutions elapsed since the initiation of the present acceleration enrichment sequence.

11. In an internal combustion engine system including means for normally generating primary fuel control pulses and means responsive to the duration of said fuel control pulses for selectively controlling quantity of fuel supplied to said engine for combustion purposes, an improved acceleration enrichment compensation method comprising the steps of determining a need for acceleration enrichment, generating an initial immediate Tip-In fuel control pulse if no main fuel control pulse is presently being generated and a delayed Tip-In fuel control pulse if a main fuel control pulse is presently being generated, and modifying subsequently generated main fuel control pulses with a long term acceleration enrichment factor, said modifying said normally-generated main fuel control pulses further including computing a first acceleration enrichment multiplier value as a function of engine speed, computing a second acceleration enrichment multiplier value as a function of air temperature, computing a third acceleration enrichment multiplier value as a function of decay where decay represents the number of engine revolutions having elapsed since the initiation of the current acceleration enrichment sequence, multiplying said first, second and third acceleration enrichment modifier values to obtain said factor "K", and multiplying said normally-computed main fuel control pulse by the quantity (1+K) to arrive at said fully-acceleration-enrichment-compensated fuel control pulse for achieving said long-term gradual compensation for the detected acceleration.

* * * * *